US006208818B1

(12) United States Patent
Noda

(10) Patent No.: US 6,208,818 B1
(45) Date of Patent: Mar. 27, 2001

(54) PROCESS CARTRIDGE AND ELECTROPHOTOGRAPHIC IMAGE FORMING APPARATUS

(75) Inventor: Shinya Noda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/030,389

(22) Filed: Feb. 25, 1998

(30) Foreign Application Priority Data

Feb. 26, 1997 (JP) ..... 9-058272

(51) Int. Cl.[7] ..... G03G 15/00
(52) U.S. Cl. ..... 399/111; 399/113
(58) Field of Search ..... 399/111, 113

(56) References Cited

U.S. PATENT DOCUMENTS

| | | | | |
|---|---|---|---|---|
| 5,331,372 | | 7/1994 | Tsuda et al. | 355/200 |
| 5,404,198 | | 4/1995 | Noda et al. | 355/200 |
| 5,488,459 | | 1/1996 | Tsuda et al. | 355/211 |
| 5,583,613 | | 12/1996 | Kobayashi et al. | 355/200 |
| 5,608,509 | | 3/1997 | Shirai et al. | 399/351 |
| 5,623,328 | | 4/1997 | Tsuda et al. | 399/111 |
| 5,642,187 | * | 6/1997 | Nomura et al. | 399/111 |
| 5,659,847 | | 8/1997 | Tsuda et al. | 399/113 |
| 5,669,042 | | 9/1997 | Kobayashi et al. | 399/111 |
| 5,774,766 | * | 6/1998 | Karakama et al. | 399/111 |

* cited by examiner

*Primary Examiner*—Arthur T. Grimley
*Assistant Examiner*—Greg Moldafsky
(74) *Attorney, Agent, or Firm*—Fitzpatrick, Cella, Harper & Scinto

(57) ABSTRACT

A cartridge frame used in a process cartridge, a process cartridge detachably mountable to a main body of an electrophotographic image forming apparatus, and such an electrophotographic image forming apparatus includes an electrophotographic photosensitive member, a charge member for charging the electrophotographic photosensitive member, and a support member for rotatably supporting longitudinal ends of the charge member and for regulating an outward shifting movement of the charge member in a longitudinal direction. The cartridge frame includes a first mounting portion for mounting the electrophotographic photosensitive member, a second mounting portion for mounting the support member, a regulating portion for regulating a longitudinal outward shifting movement of the support member when the charge member is supported by the support member mounted on the second mounting portion, and a support portion for supporting a periphery of the regulating portion.

11 Claims, 16 Drawing Sheets

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus.

The "electrophotographic image forming apparatus" is an apparatus for forming an image on a recording medium by using an electrophotographic image forming system. For example, the electrophotographic image forming apparatus may be an electrophotographic copying machine, an electrophotographic printer (for example, a laser beam printer or an LED printer), an electrophotographic facsimile or an electrophotographic word processor.

The "process cartridge" incorporates therein an electrophotographic photosensitive member and a charge member for charging the electrophotographic photosensitive member as a cartridge unit which can detachably be mounted to a main body of an electrophotographic image forming apparatus or incorporates therein an electrophotographic photosensitive member and at least one of such a charge means, a developing means for developing a latent image formed on the electrophotographic photosensitive member and a cleaning means for removing developer remaining on the electrophotographic photosensitive member as a cartridge unit which can detachably be mounted to a main body of an electrophotographic image forming apparatus.

2. Related Background Art

A conventional electrophotographic image forming apparatus, such as an electrophotographic copying machine, a laser beam printer or the like includes a photosensitive drum. Well-known processes such as charging, exposure and development are successively effected regarding the photosensitive drum to thereby form a toner image on the photosensitive drum and to transfer the toner image onto a recording medium. Thereafter, residual toner remaining on the photosensitive drum is removed by a cleaning device. In this way, the image is formed.

In such electrophotographic image forming apparatuses, recently, a process cartridge has been adopted to make the apparatus compact and simplify its maintenance. In the process cartridge, the photosensitive drum and the process means (such as a charge member, a developing member and a cleaning member) acting on the photosensitive drum are integrally incorporated as a cartridge unit which can detachably be mounted to a main body of the image forming apparatus by an operator himself.

Such a process cartridge has a grip through which the operator mounts the process cartridge to the main body of the image forming apparatus by his hand.

SUMMARY OF THE INVENTION

An object of the present invention is to provide a cartridge frame, a process cartridge, and an electrophotographic image forming apparatus to which such a process cartridge can detachably be mounted in which a charge member is positively supported.

Another object of the present invention is to provide a cartridge frame, a process cartridge, and an electrophotographic image forming apparatus to which such a process cartridge can detachably be mounted, in which the longitudinal ends of a charge member are rotatably supported and an outward shifting movement of the charge member is surely regulated by a support member for regulating the outward shifting movement of the charge member.

A further object of the present invention is to provide a cartridge frame used in a process cartridge which includes an electrophotographic photosensitive member, a charge member for charging the electrophotographic photosensitive member, and a support member for rotatably supporting longitudinal ends of the charge member and for regulating an outward shifting movement of the charge member in a longitudinal direction. The process catridge can detachably be mounted to a main body of an electrophotographic image forming apparatus. The cartridge frame comprises a first mounting portion for mounting the electrophotographic photosensitive member, a second mounting portion for mounting the support member, a regulating portion for regulating a longitudinal outward shifting movement of the support member when the charge member is supported by the support member mounted on the second mounting portion, and a support portion for supporting a periphery of the regulating portion. The first and second mounting portions, the regulating portion, and the support portion are integrally molded from plastic material.

A still further object of the present invention is to provide a process cartridge, and an electrophotographic image forming apparatus to which such a process cartridge can detachably be mounted, in which a shaft rotatably interconnecting a cartridge frame and a developing frame for supporting a developing member can be prevented from being disengaged.

The other objects and features of the present invention will be apparent from the following detailed explanation referring to the accompanying drawings.

DETAILED DESCRIPTION OF THE PREFERRED EMBODIMENTS

The present invention will now be fully explained in connection with embodiments thereof with reference to the accompanying drawings. An image forming apparatus according to the embodiments is embodied as a laser beam printer. In the following explanation, regarding various elements, a horizontal direction perpendicular to a mounting and dismounting direction of a process cartridge with respect to an image forming apparatus is referred to as a "longitudinal direction".

(First Embodiment)

Now, a process cartridge and an image forming apparatus to which such a process cartridge can detachably be mounted will be fully explained with reference to FIGS. 1 to 12.

First of all, entire construction of the process cartridge and the image forming apparatus using such a process cartridge will be explained.

(Entire Construction)

Figure 3:
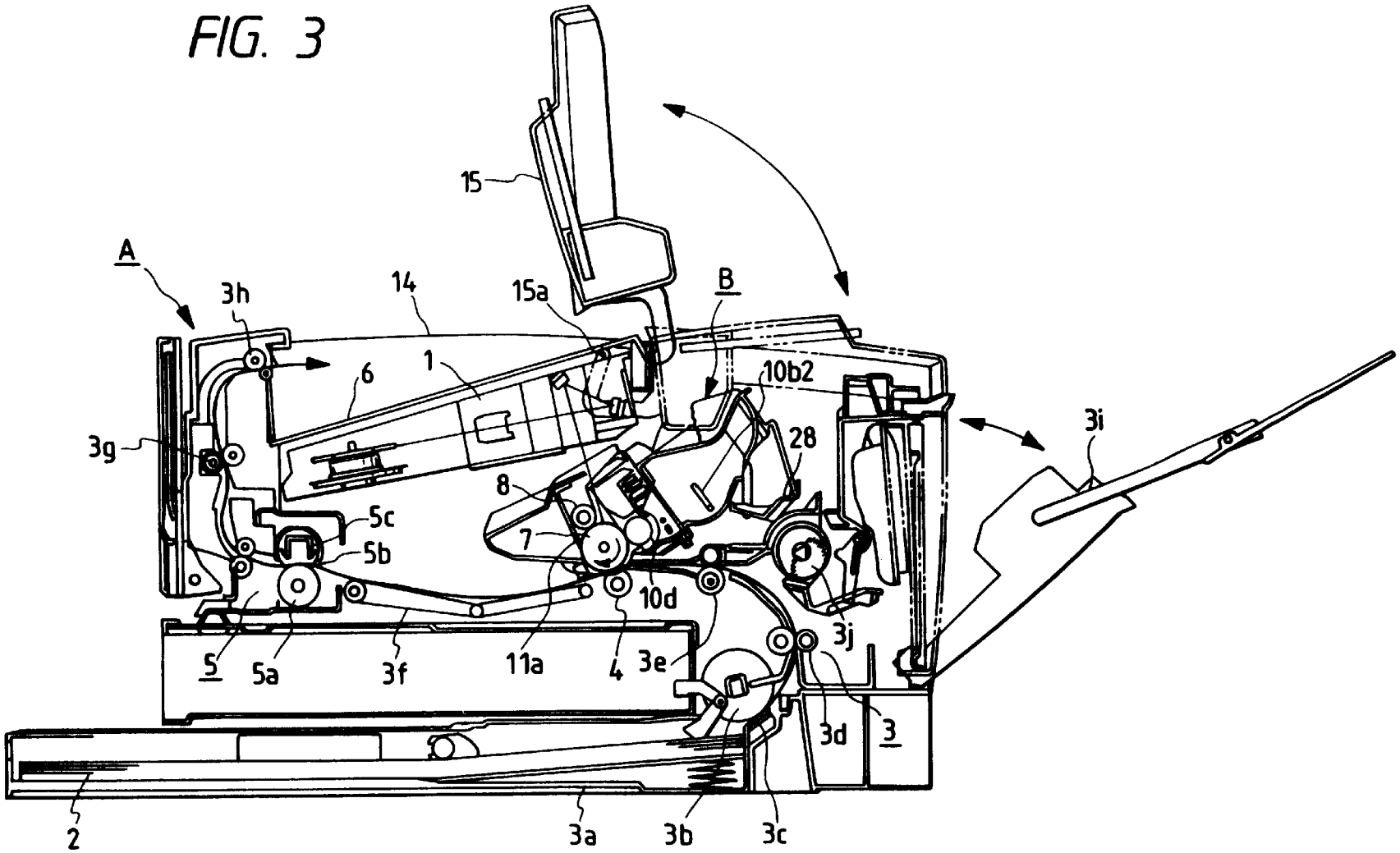
FIG. 3 is an elevational sectional view of an image forming apparatus and the process cartridge.

As shown in FIG. 3, in an electrophotographic image forming apparatus (laser beam printer) A, a latent image is formed on a drum-shaped electrophotographic photosensitive member 7 by projecting information light, corresponding to image information from an optical system 1 onto the photosensitive member 7, and then the latent image is developed with developer (referred to as "toner" hereinafter) to form a toner image. In synchronism with the formation of the toner image, recording media 2 are separated and supplied, one-by-one from a sheet supply cassette 3*a* by means of a pick-up roller 3*b* and urging member 3*c* urged against the pick-up roller. The separated recording medium 2 is conveyed by a convey means 3 comprised of a pair of convey rollers 3*d* and a pair of regist rollers 3*e*. Then, the toner image formed on the photosensitive member 7 of a process cartridge B is transferred onto the recording medium 2 by applying voltage to a transfer roller (transfer means) 4.

Thereafter, the recording medium 2 is sent to a fixing means 5 through a convey belt 3*f*. The fixing means 5 includes a drive roller 5*a*, and a fixing rotary member 5*b* formed from a cylindrical sheet having a heater 5*c* therein and rotatably supported by a support. While the recording medium 2 is passing between the roller 5*a* and the fixing rotary member 5*b*, heat and pressure are applied to the recording medium to thereby fix the toner image to the recording medium. Thereafter, the recording medium 2 is conveyed through a reverse rotation path by means of pairs of discharge rollers 3*g*, 3*h* and is discharged onto a discharge tray 6. Incidentally, in the image forming apparatus A, manual sheet insertion supply can be permitted by providing a manual insertion tray 3*i* and a manual insertion roller 3*j*.

(Process Cartridge)

Figure 4:
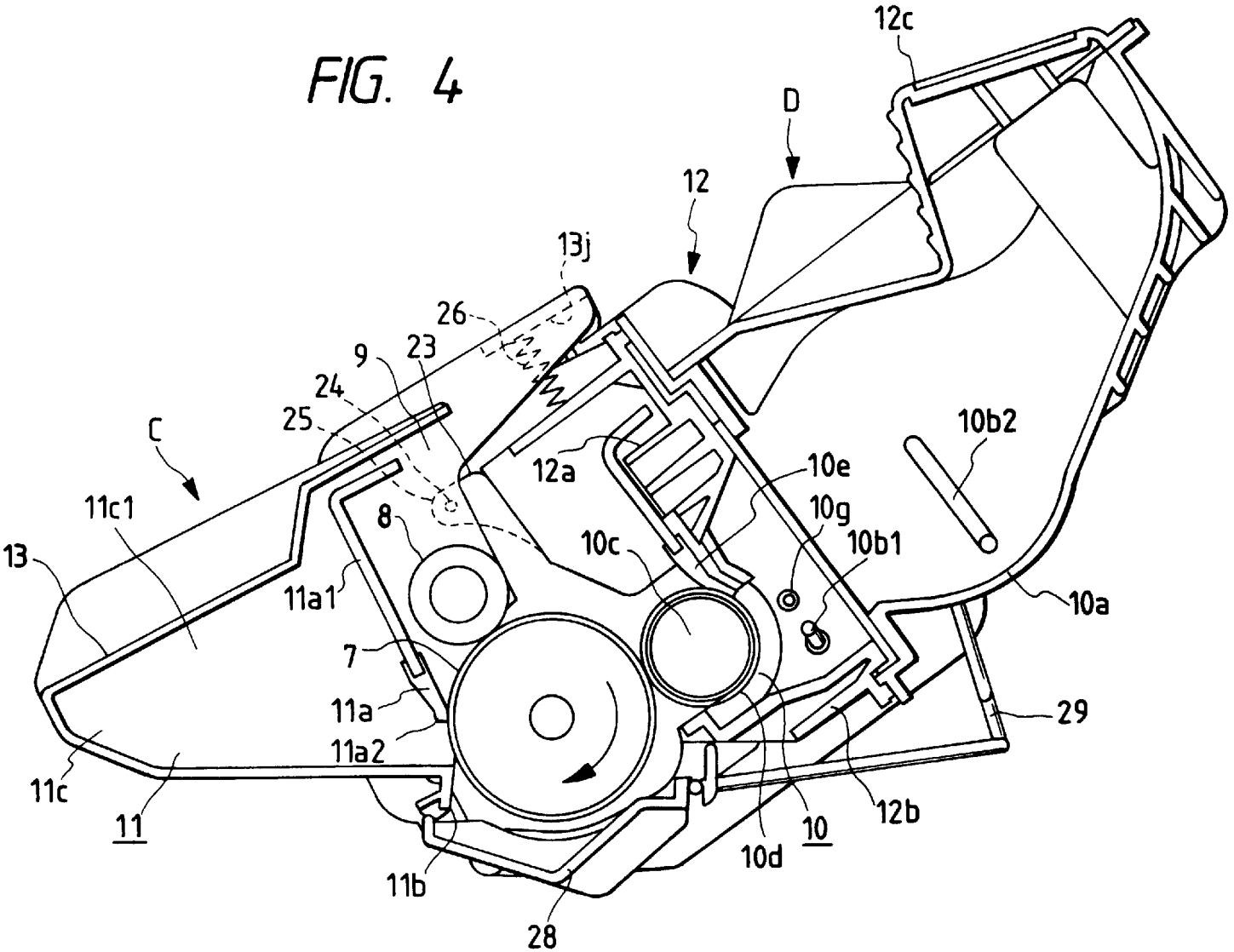
FIG. 4 is an elevational sectional view of the process cartridge.

The process cartridge B includes the electrophotographic photosensitive member and at least one process means. The process means may be, for example, a charge means for charging the electrophotographic photosensitive member, a developing means for developing a latent image formed on the electrophotographic photosensitive member and/or a cleaning means for removing the residual toner remaining on the electrophotographic photosensitive member. As shown in FIG. 4, in the process cartridge B according to the illustrated embodiment, the photosensitive drum (electrophotographic photosensitive member) 7 having a photosensitive layer is rotated and is uniformly charged by applying voltage to a charge roller (charge means) 8. Then, a latent image is formed by projecting the image light from the optical system 1 onto the photosensitive drum 7 through an opening portion 9, and the latent image is developed by a developing means 10.

In the developing means 10, the toner contained in a toner containing portion 10*a* is sent by means of rotatable first and second toner feed members (toner feed member) 10*b*1, 10*b*2 disposed within the toner containing portion 10*a*. While a developing roller (developing rotary member) 10*d*, having a fixed magnet 10*c* therein, is being rotated, a toner layer is formed on a surface of the developing roller 10*d* by applying frictional charge by means of a developing blade 10*e*, and the toner on the toner layer is transferred onto the latent image on the photosensitive drum 7 to thereby form a toner image.

The toner image is transferred onto the recording medium 2 by applying voltage, having a polarity opposite to that of the toner image, to the transfer roller 4. Thereafter, residual toner remaining on the photosensitive drum 7 is removed by a cleaning means 11 comprising a cleaning blade 11*a* for scraping the residual toner on the photosensitive drum, a dip sheet 11*b* for receiving the scraped toner and a waste toner containing portion 11*c* for collecting the waste toner.

At a contact area between the photosensitive drum 7 and the transfer roller 4, an opening portion is formed in a cartridge frame, and this opening portion is closed by a shutter 28. The shutter 28 constitutes a quadric link mechanism having the cartridge frame as a fixed node and is supported by a link member 29 and an arm member (another link) (FIGS. 1 and 8 to 12).

Various members, such as the photosensitive drum 7, are contained in the cartridge frame as a unit which can detachably be mounted to a cartridge mounting means of a main body 14 of the image forming apparatus. The cartridge frame is formed by joining a toner developing frame 12 (obtained by welding together an upper developing frame 12*a*, a lower developing frame 12*b*, the toner containing portion 10*a* and a lid member 12*c*) and a cleaning frame 13 forming a cleaning container.

<Mounting and Dismounting of Process Cartridge>

Now, an arrangement for mounting and dismounting the process cartridge with respect to the main body 14 of the image forming apparatus will be explained.

Figure 5:
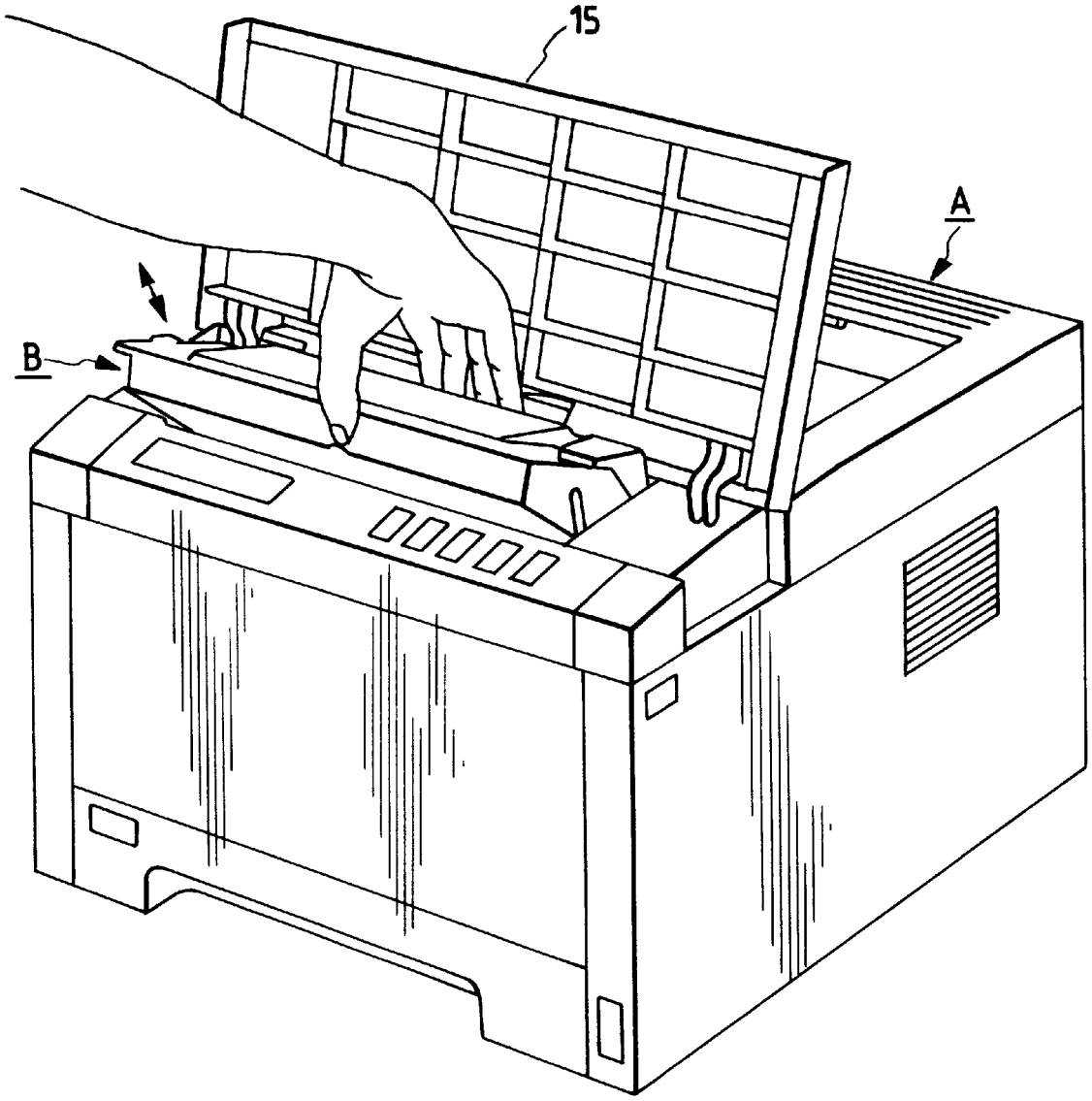
FIG. 5 is a perspective view of the image forming apparatus to which the process cartridge is detachably be mounted.
Figure 6:
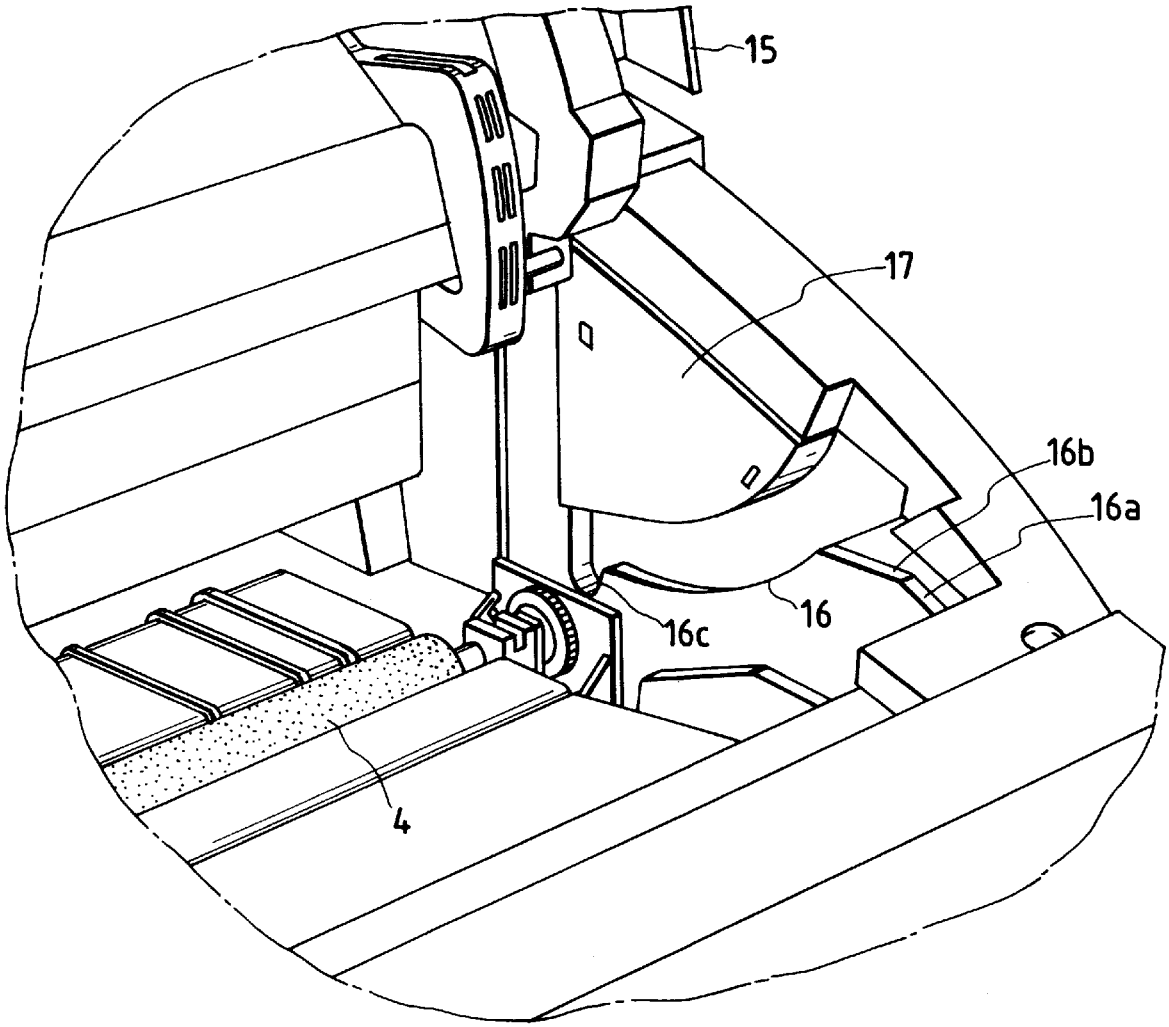
FIG. 6 is a perspective view of a right guide of the image forming apparatus for guiding the mounting and dismounting of the process cartridge.
Figure 7:
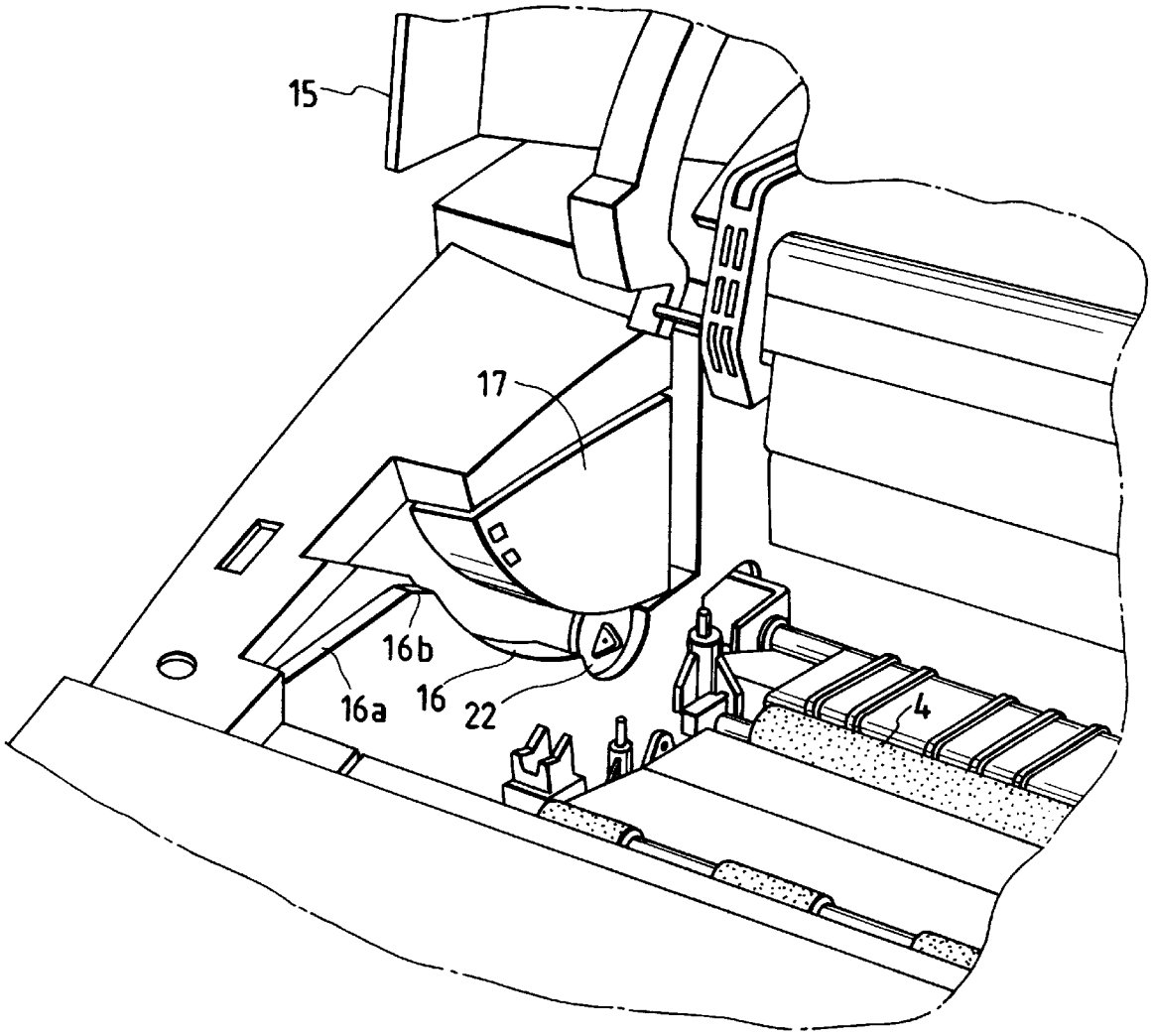
FIG. 7 is a perspective view of a left guide of the image forming apparatus for guiding the mounting and dismounting of the process cartridge.
Figure 8:
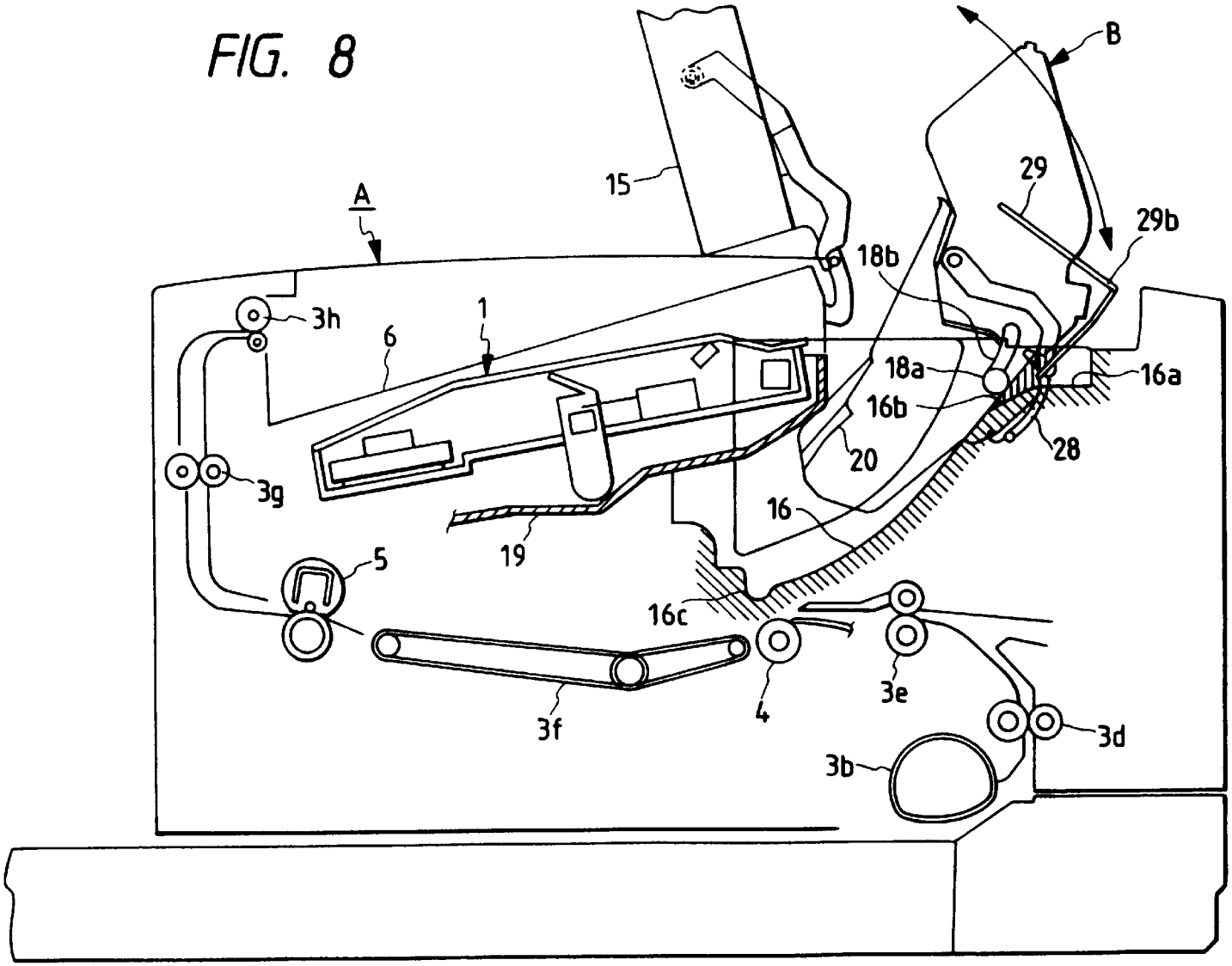
FIGS. 8, 9, 10, 11 and 12 are explanatory views for explaining the mounting and dismounting of the process cartridge with respect to the image forming apparatus.

The mounting and dismounting of the process cartridge B is effected after an open/close member 15 is opened as shown in FIG. 5. When the open/close member 15 is opened around a shaft 15*a* (FIG. 3), a space of the cartridge mounting portion is exposed. As shown in FIGS. 6 and 7, curved (arc in the illustrated embodiment) guide rails 16 extending forwardly and downwardly and concave downwardly are symmetrically disposed on both sides of the cartridge mounting space. Guide members 17 are provided above the guide rails. Further, each guide 16 is provided at its entrance portion with a first inclined surface 16*a* (as a hooked portion) which contacts a protruded portion 29*b* of the link member 29 provided for opening and closing the shutter 28 of the process cartridge B, and a second inclined surface 16*b* contiguous with the first inclined surface 16*a* and having inclination greater than that of the first inclined surface.

Figure 1:
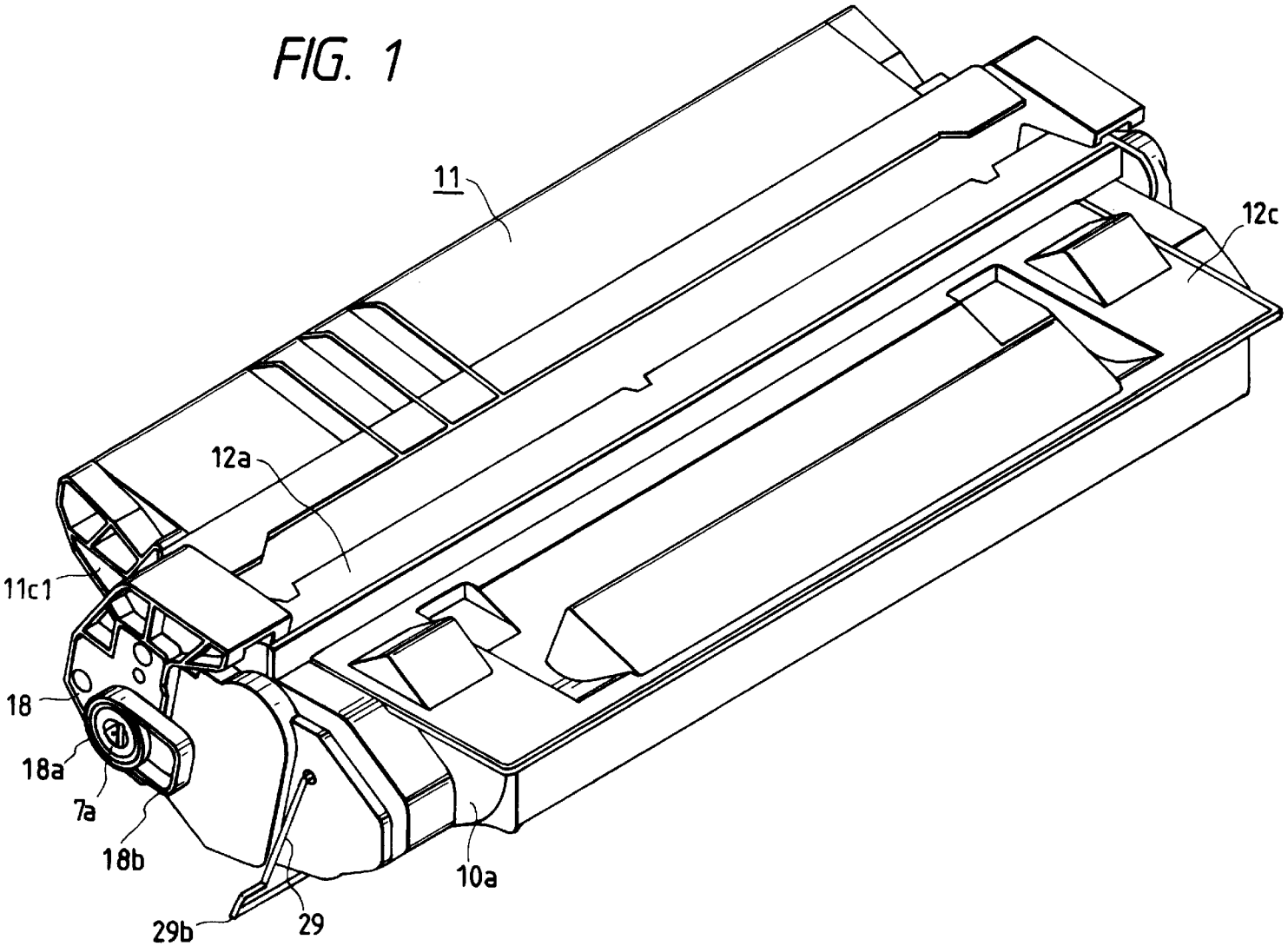
FIG. 1 is a perspective view showing a left side surface of a process cartridge according to a preferred embodiment of the present invention.
Figure 2:
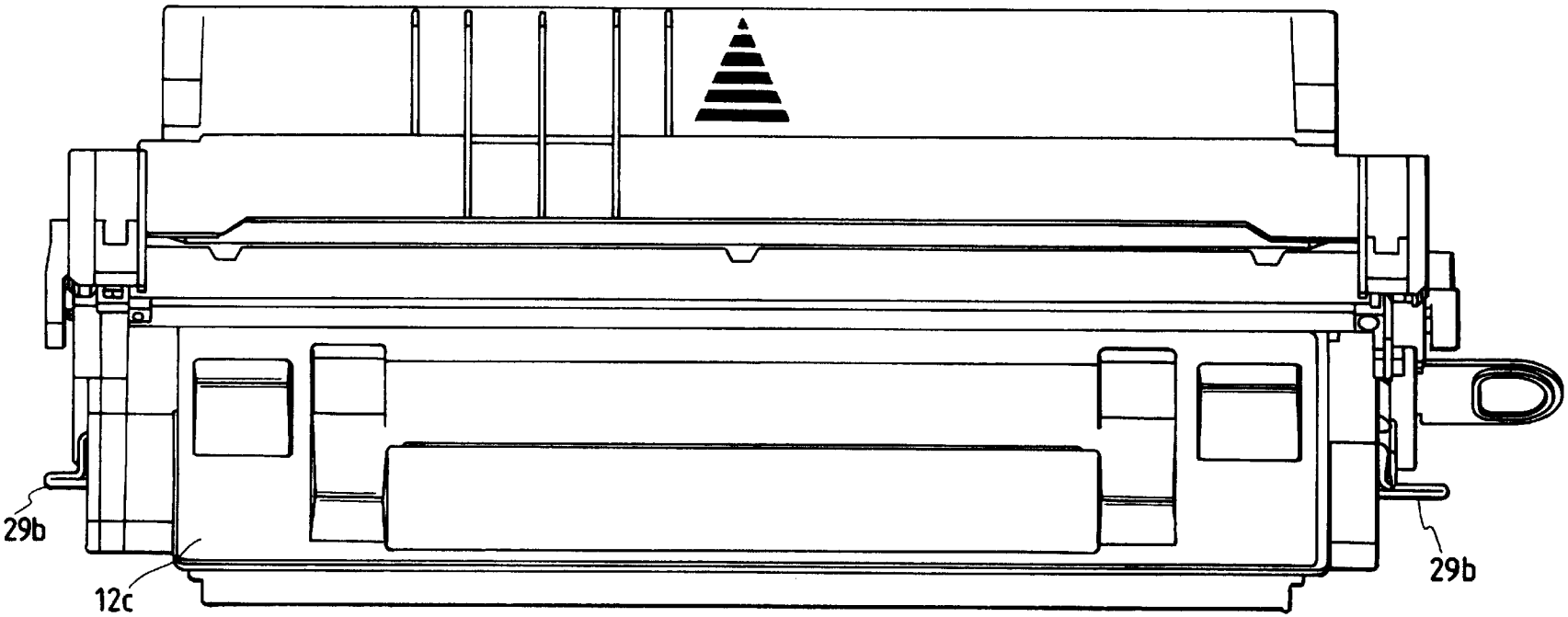
FIG. 2 is a plan view of the process cartridge according to the preferred embodiment.

On the other hand, the process cartridge is provided at its both side surfaces (in the longitudinal direction) with guide portions corresponding to the guide rails 16. The guide portions are symmetrically protruded outwardly from the side surfaces of the cartridge frame in the longitudinal direction. As shown in FIG. 1, each guide portion has a boss (first guide portion) 18*a* and a rib (second guide portion)

18*b*. The bosses 18*a* are disposed on line passing through a rotation axis of the photosensitive drum 7, and each rib 18*b* is contiguous with the corresponding boss 18*a* and extends rearwardly in an inserting direction of the process cartridge B and has a curved (arc in the illustrated embodiment) configuration corresponding to the corresponding guide rail 16.

Figure 9:
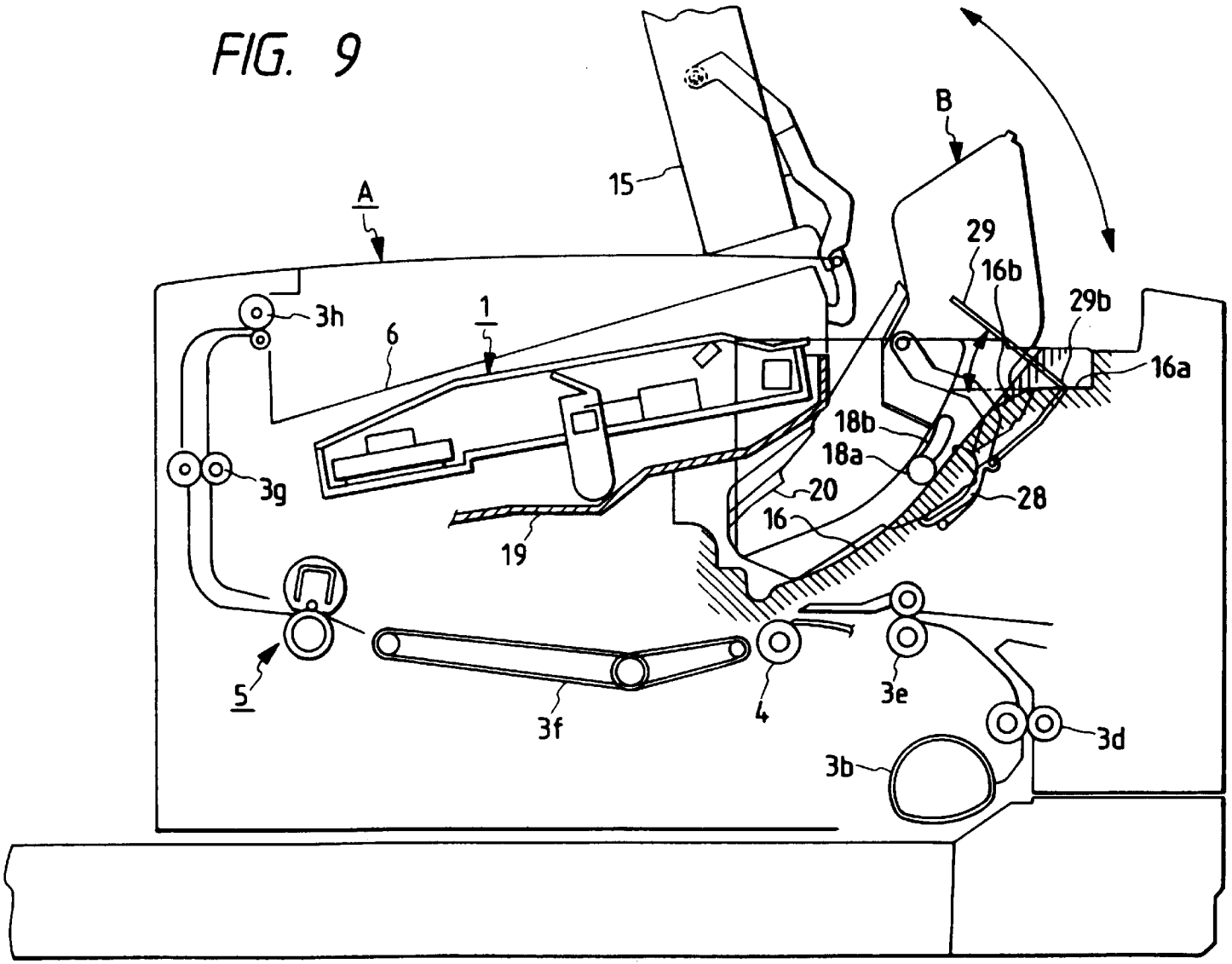
Figure 10:
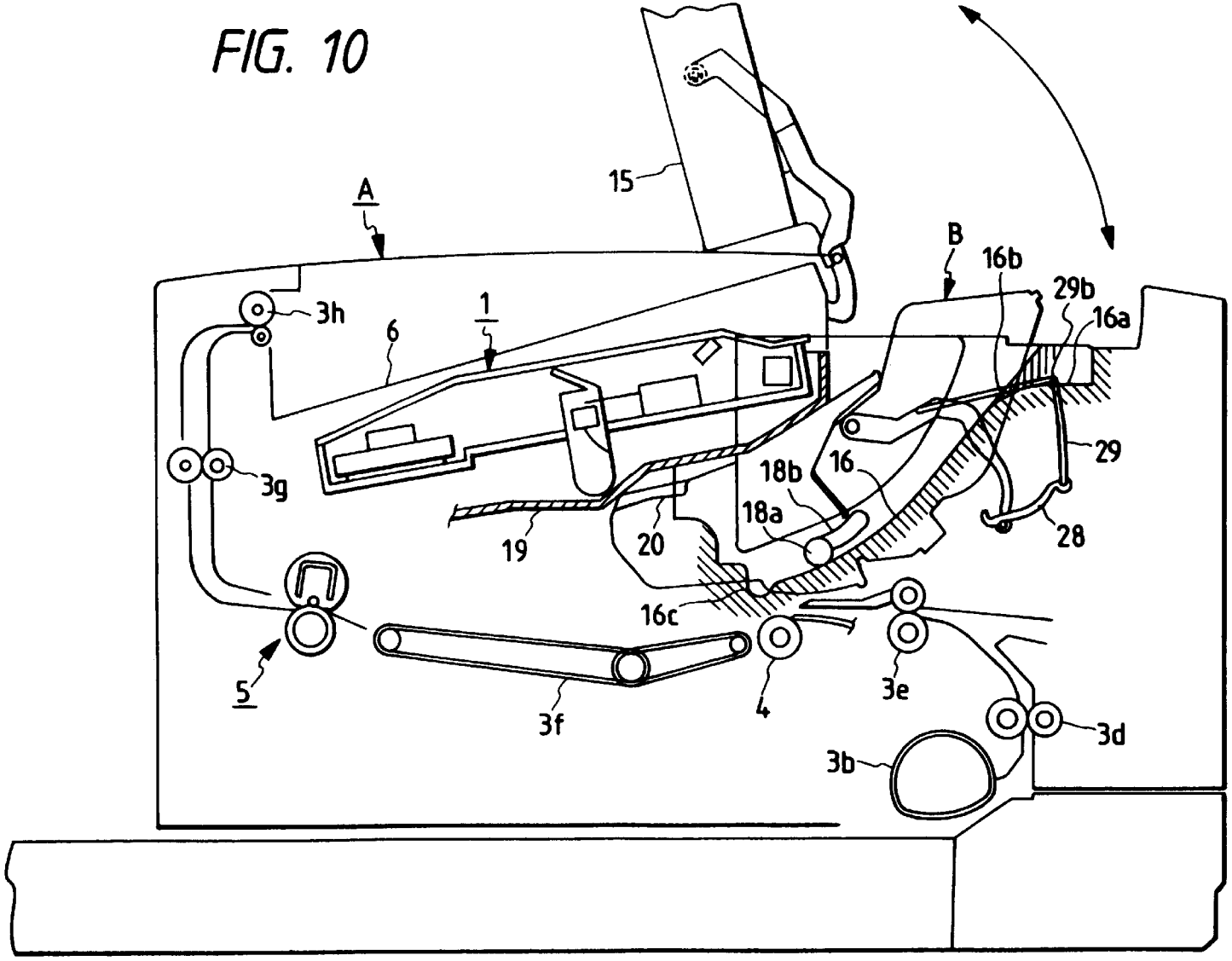
Figure 11:
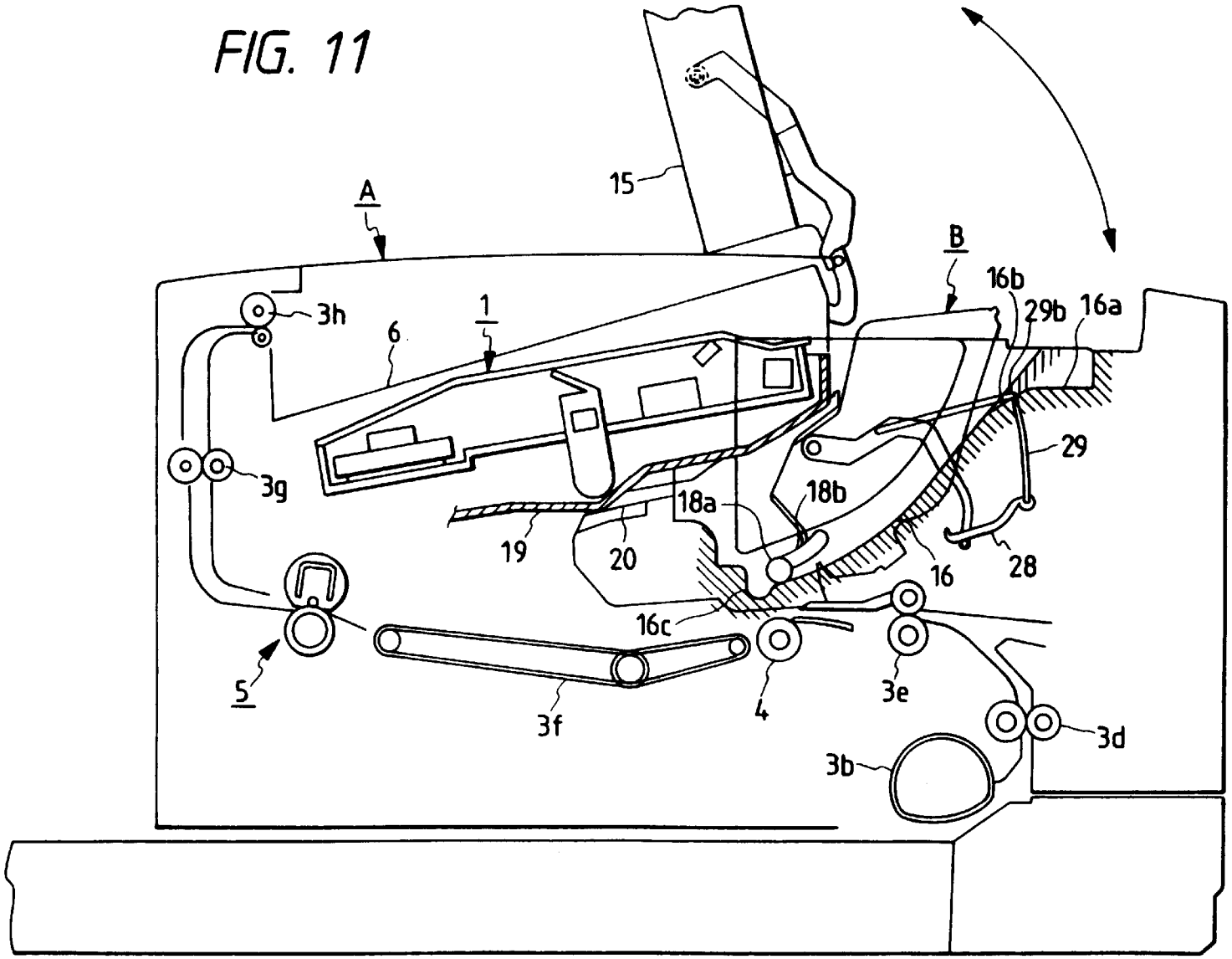
Figure 12:
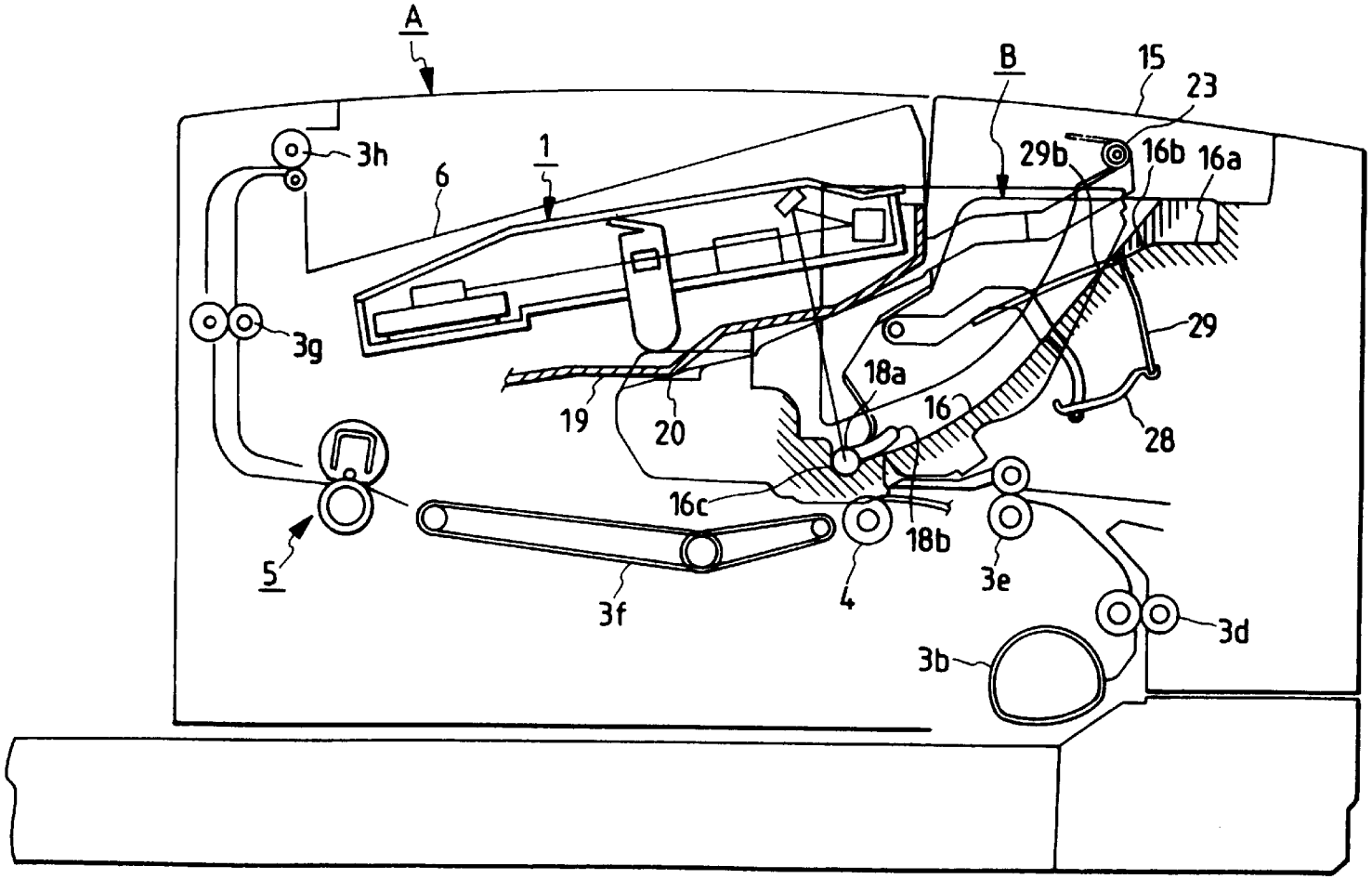

With the arrangement as mentioned above, when the process cartridge B is mounted, as shown in FIGS. 8 to 12, a forward end of the process cartridge is inserted below the optical system 1 of the image forming apparatus while the bosses 18*a* are guided and the ribs 18*b* along the guide rails 16. Since the guide rails 16 have a curved configurations and the guide members 17 (disposed above the guide rails) have the similar curved configurations and since the ribs 18*b* have similar curved configurations, as the process cartridge is advanced in the inserting direction, the process cartridge B becomes horizontal. When the process cartridge B is further inserted, the posture of the process cartridge is changed gradually as shown in FIGS. 9 to 11, and then, as shown in FIG. 12, abutment surfaces 20 provided at both ends of the cleaning frame 13 abut against an abut member 19 of the main body 14 of the image forming apparatus, and then, the bosses 18*a* of the process cartridge B are received by receiving recesses 16*c* formed in end portions of the guide rails 16. As a result, a drive transmitting portion 7*a* integrally formed with a drum gear (7*b* in FIG. 13; not shown in FIG. 12) secured to the photosensitive drum 7 can be connected to a drive transmitting means 22 (FIG. 7) of the main body 14 of the image forming apparatus. Incidentally, at the same time when the process cartridge B is mounted in this way, movement of the projection 29*b* of the link member 29 for supporting the shutter 28 is prevented by the first and second inclined surface 16*a*, 16*b*, thereby opening the shutter 28.

As mentioned above, in the process cartridge according to the illustrated embodiment, a housing is constituted by joining the toner containing portion 19*a* as the toner frame, the developing frame 12 obtained by integrally assembling the upper developing frame 12*a* and the lower developing frame 12*b*, and the cleaning frame 13. Now, the construction of the housing will be explained.

As shown in FIG. 4, a toner feed member 10*b*2 is rotatably attached to the toner containing portion 10*a*. A developing roller 10*d* and a developing blade 10*e* are attached to the lower developing frame 12*b*, and a toner feed member 10*b*1 for circulating the toner in the developing chamber is rotatably provided in the vicinity of the developing roller 10*d*. Further, as shown in FIG. 4, an antenna rod 10*g* extending substantially in parallel with the developing roller 10*d* is attached to the lower developing frame 12*b* in an opposed relation to the longitudinal direction of the developing roller 10*d*. By integrally welding (supersonic welding in the illustrated embodiment) the toner frame (obtained by welding a lid member 12*c* to the toner containing portion 10*a*) and the developing frame 12 (comprised of the upper and lower developing frames 12*a*, 12*b*), an integral developing unit D is formed.

Further, as shown in FIG. 4, the photosensitive drum 7, charge roller 8 and various members of the cleaning means 11 are attached to the cleaning frame 13, thereby forming a cleaning unit C. By interconnecting the developing unit D and the cleaning unit C via shaft members (round pins) 24, the process cartridge B is constituted. That is to say, as shown in FIGS. 4 and 15, circular rotation holes 25 in parallel with the developing roller 10*d* are formed in free ends of arm portions 23 provided on both longitudinal (axial direction of the developing roller 10*d*) ends of the developing frame 12.

Figure 15:
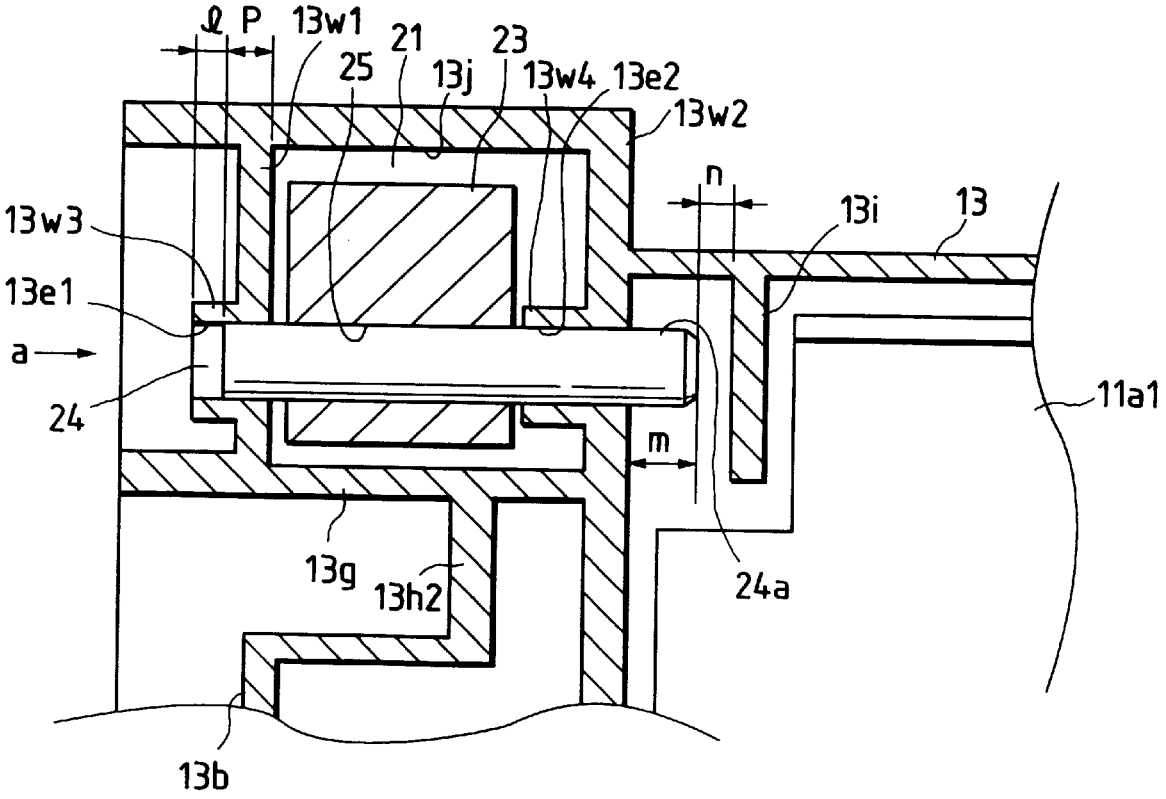
FIG. 15 is a longitudinal sectional view, in parallel with a photosensitive drum, of the jointed portion between the cleaning frame and the developing frame of the process cartridge.

On the other hand, recessed portions 21 for receiving the arms 23 are provided (at two points) on both longitudinal ends of the cleaning frame 13 (FIG. 15). By inserting the arm portions 23 into the recessed portions 21 and by fitting the shaft members 24 into the rotation holes 25 of the arm portions 23 through attachment holes 13*e*1 of longitudinal outer wall members 13*w*1 of the cleaning frame 13 to press-fit the shaft members into press-fit portions 13*e*2, the developing unit D and the cleaning unit C are interconnected for relative rotation around the shaft members 24. The press-fit portions 13*e*2 are formed in bosses 13*w*4 protruded outwardly from wall members 13*w*2 disposed inside the wall members 13*w*1 in the longitudinal direction. In this case, compression springs 26 mounted on projections (not shown) formed on roots of the arm portions 23 abut against upper walls 13*j* of the recessed portions 21 of the cleaning frame 13, thereby biasing the developing frame 12 (12*a*, 12*b*) downwardly, with the result that the developing roller 10*d* is urged toward the photosensitive drum 7 positively. Spaced rollers (not shown) each having a diameter greater than that of the developing roller 10*d* are provided on both longitudinal ends of the developing roller 10*d* and are urged against the photosensitive drum 7 to provide a predetermined gap (about 300 $\mu$m) between the photosensitive drum 7 and the developing roller 10*d*.

Accordingly, the developing unit D and the cleaning unit C are relatively rotated around the shaft members 24. And, by the elastic forces of the compression springs 26, the positional relation between the peripheral surface of the photosensitive drum 7 and the peripheral surface of the developing roller 10*d* is kept constant.

Figure 13:
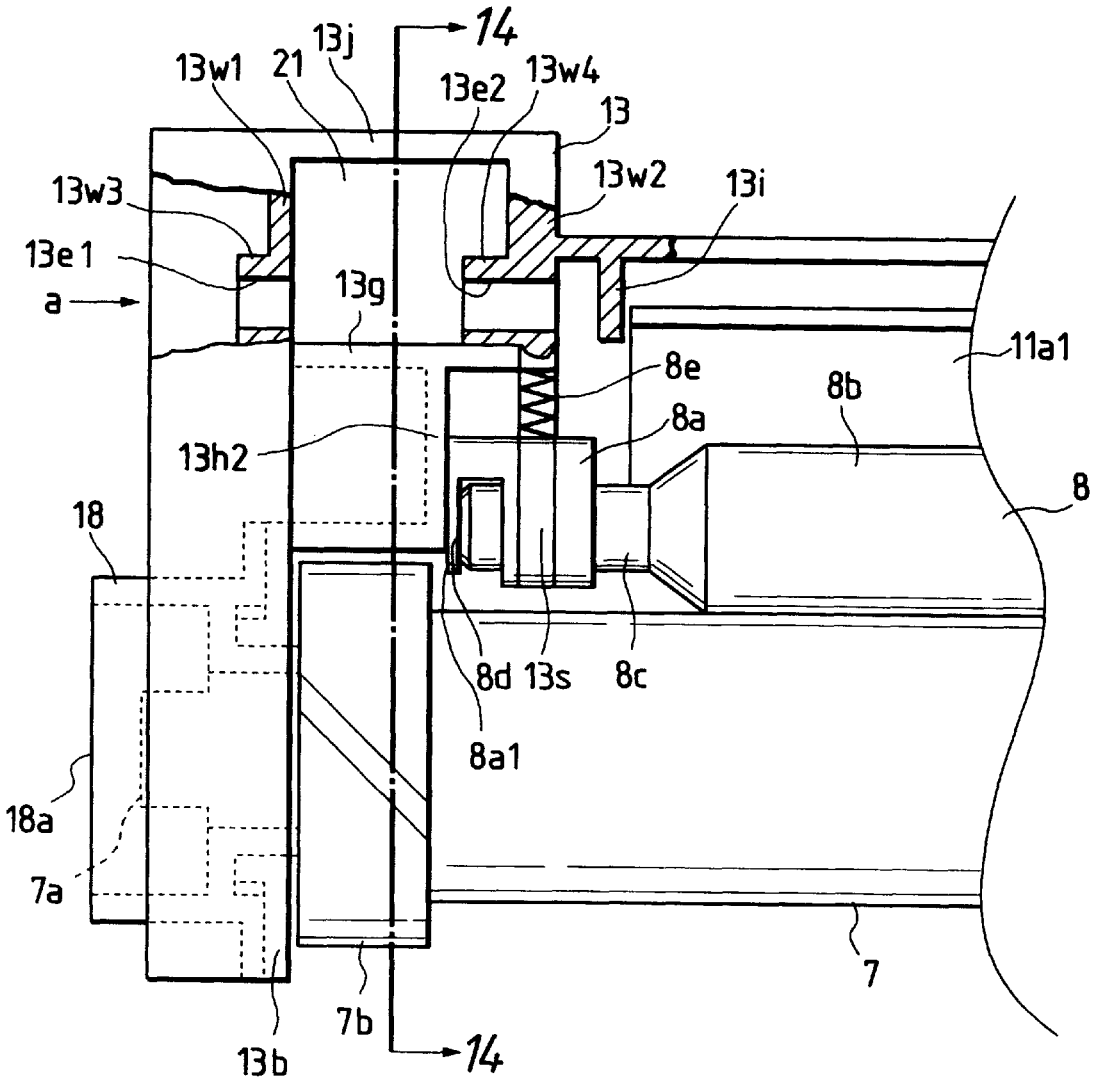
FIG. 13 is a front view of a longitudinal end portion of a cleaning frame including a section of a jointed portion between the cleaning frame and a developing frame of the process cartridge.
Figure 14:
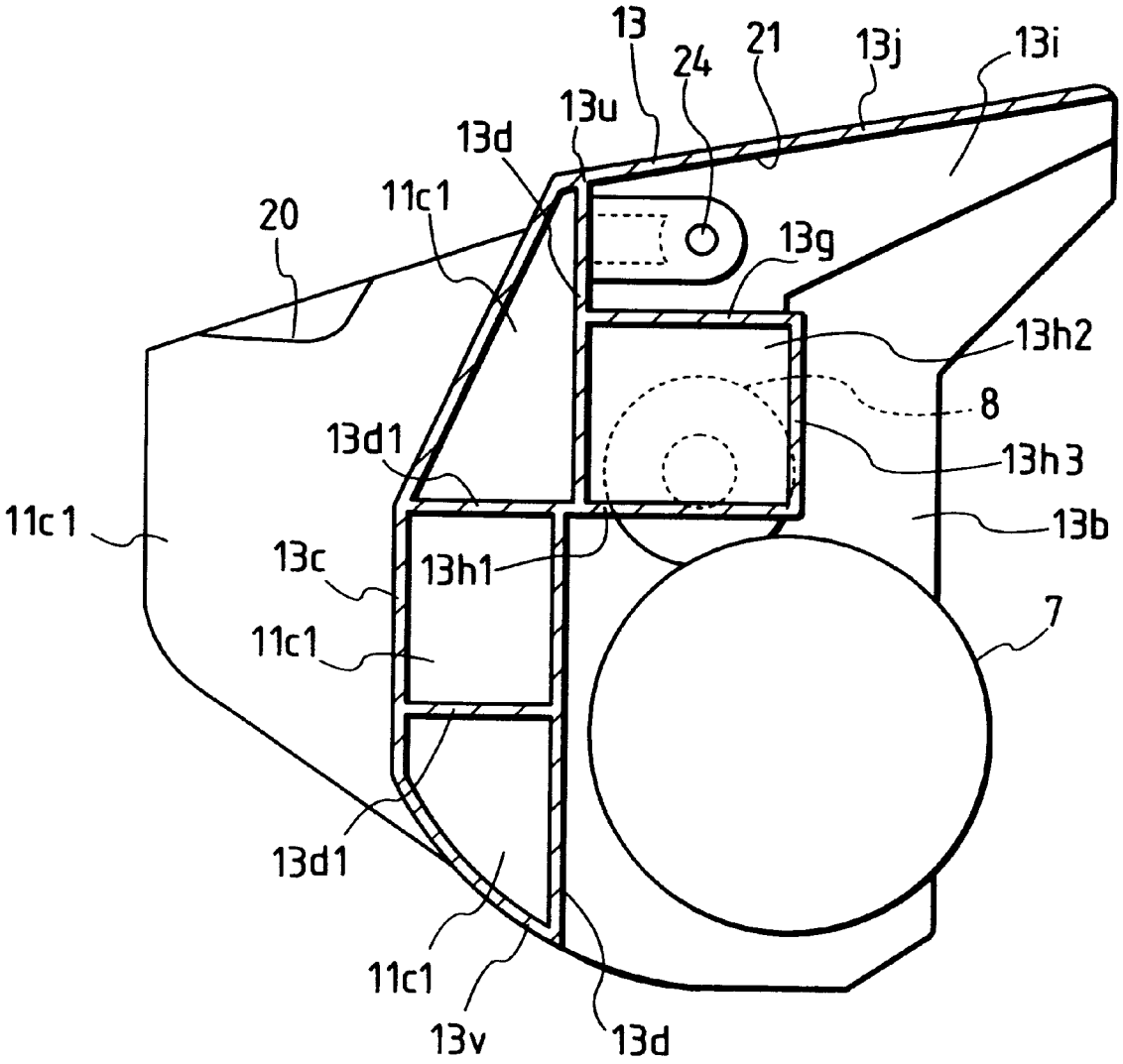
FIG. 14 is a sectional view taken along the line 14—14 in FIG. 13.

The cleaning frame 13 is integrally molded from resin and, as shown in FIG. 14, has a container shape opened at the right, and side surfaces 11*c*1 on both longitudinal ends of the waste toner containing portion 11*c* are flat substantially in parallel with the plane of FIG. 14. The both side surfaces 11*c*1 of the cleaning frame 13 are bent at a crank shape looked at from the above and flatly extend toward the photosensitive drum 7 to form side walls 13*b* at sides of the photosensitive drum 7 (see FIG. 13). A lower portion of the photosensitive drum 7 is exposed to the transfer roller 4. The side surfaces 11*c*1 of the waste toner containing portion 11*c* are substantially flush with the inner wall members 13*w*2 shown in FIG. 13 in the longitudinal direction. Further, guide members 13*s* for guiding charge roller bearings 8*a* for vertical movement are integrally formed with lower portion of the wall members 13*w*2 substantially flush with the wall members 13*w*2 in the longitudinal direction, and a coating roller portion 8*b* of the charge roller 8 is disposed inside the guide members 13*s*. In the vicinity of inner surfaces of the inner wall members 13*w*2, a support metal plate 11*a*1 for the cleaning blade 11*a* is disposed with the interposition of and near ribs 13*i* of the cleaning frame 13. Incidentally, a rubber blade 11*a*2 is secured to the support metal plate 11*a*1 by adhesive and the support metal plate 11*a*1 is secured to the cleaning frame 13 so that the rubber blade 11*a*2 is urged against the generatrix of the photosensitive drum 7 (see FIG. 4), thereby scraping the residual toner remaining on the photosensitive drum 7 after the transferring of the toner image effected by the transfer roller 4.

The recessed portions 21 formed in the cleaning frame 13 to interconnect the cleaning frame 13 and the developing frame 12 will be described later. The outer wall members 13*w*1 in which the recessed portions 21 are formed are substantially flush (in the longitudinal direction) with the side walls 13*b* to which the bearings 18, having the bosses 18*a* and ribs 18*b* for rotatably supporting the photosensitive drum 7, are attached (see FIGS. 13 and 15). The upper walls 13*j* of the recessed portions 21 of the cleaning frame 13 are extended above the developing frame 12.

As mentioned above, the width of the cleaning frame is increased in steps from the waste toner containing portion 11*c* toward the developing frame 12 so that a single wall structure is provided on each longitudinal end of the photosensitive drum 7 and a dual wall structure is provided on each longitudinal end of the charge roller 8.

As already described in connection with FIG. 12, when the process cartridge B is mounted to the main body 14 of the image forming apparatus, the bosses 18*a* coaxial with the rotation axis 7*a* of the photosensitive drum 7 are fitted into the receiving recesses 16*c* provided in the apparatus main body 14, and the abutment surface 20 of the cleaning frame 13 abuts against the abutment member 19 of the apparatus main body 14, thereby determining the posture of the process cartridge within the apparatus main body 14. When the photosensitive drum 7 tries to rotate in the direction shown by the arrow in FIG. 3 by transmitting the driving force, a frictional force is generated by the relative sliding between the photosensitive drum 7 and the cleaning blade 11*a*. Due to this frictional force, the process cartridge is subjected to a clockwise (FIGS. 3 and 12) moment around the bosses 18*a* and the moment is transmitted to the cleaning frame 13. Further, the cleaning frame 13 is subjected to a moment around the bosses 18*a* due to the weight of the developing unit D. In addition, the wall members around the recessed portions 21 of the cleaning frame 13 are subjected to a moment (opposite to the aforementioned moment) generated by the compression springs 26 compressed between the cleaning frame 13 and the developing frame 12.

Since the process cartridges B are expendables and should be made cheaper, the amount of resin used for forming the process cartridge B has been reduced to achieve "cost-down". In the cleaning frame 13, if the thicknesses of the wall members of the frame constituting the waste toner containing portion 11*c*, the side walls 13*b* for supporting the drum shaft 7*a* of the photosensitive drum 7 and the wall members constituting the recessed portions 21 at the jointed area between the developing frame 12 and the cleaning frame 13 are merely reduced, it is understood that the cleaning frame 13 is deformed by a force generated by the above-mentioned frictional force to thereby deleteriously to affect the image forming operation.

Figure 16:
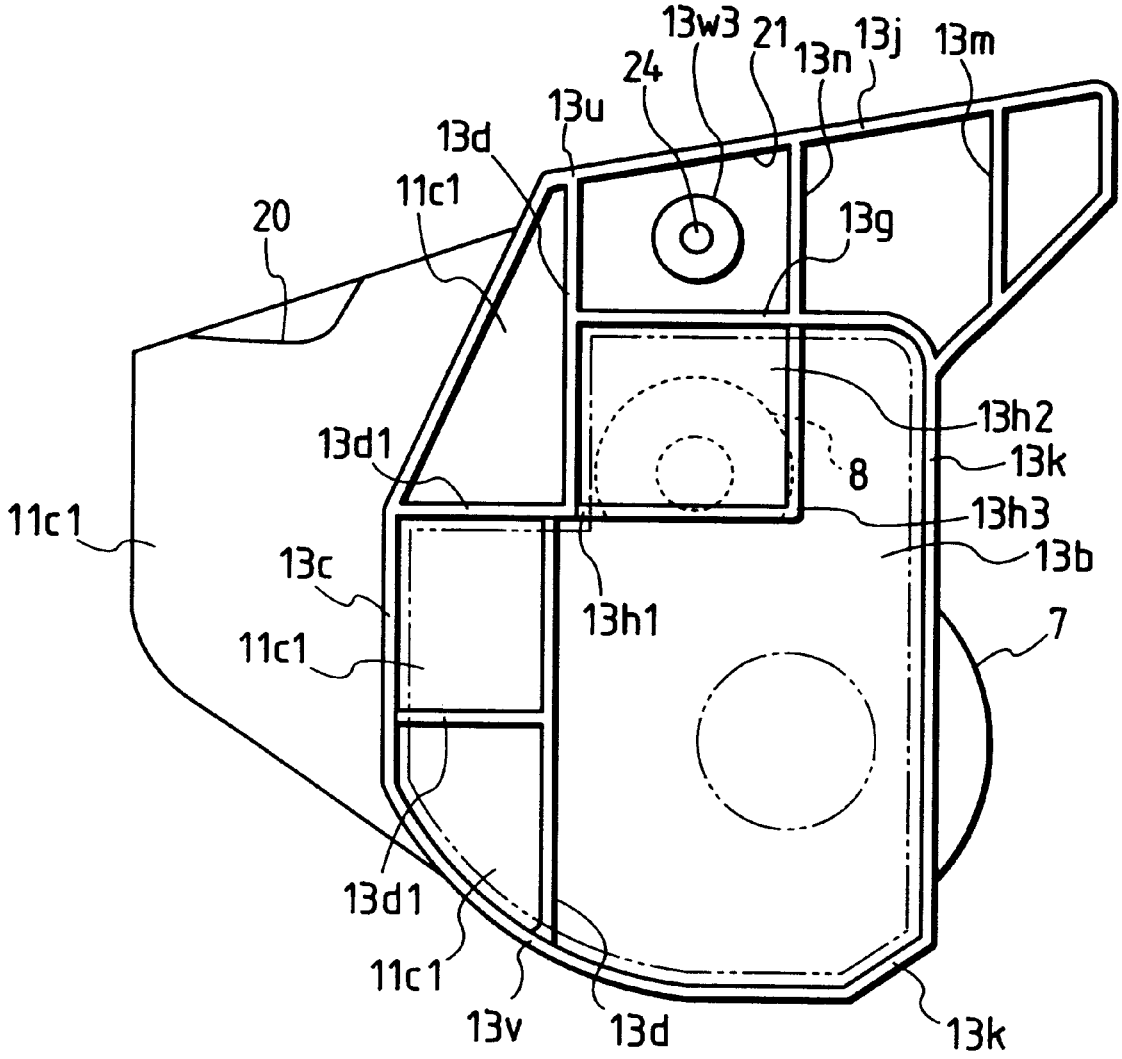
FIG. 16 is a side view of the cleaning frame.

To avoid this, in the illustrated embodiment, as shown in FIGS. 14 and 16, there are provided a vertical connecting portions 13*c* (having a wall directing toward the longitudinal direction) interconnecting the side walls 11*c* (FIG. 1) of the waste toner containing portion 11*c* of the cleaning frame 13 and the side walls 13*b* (FIG. 14) of the cleaning frame 13 disposed outwardly of the side walls 11*c*1 in the longitudinal direction. Further, between the connecting portion 13*c* and a tip circle of the drum gear 7*b* secured to the photosensitive drum 7, there is provided an intermediate wall 13*d* disposed substantially in parallel with the connecting portion 13*c*. With this arrangement, at upper and lower positions 13*u*, 13*v*, a box-shaped space opened toward the longitudinal direction is defined by the connecting portion 13*c*, intermediate wall 13*d* and side wall 11*c*1. In this way, since the enclosed box-shaped rib can be defined by the connecting portion 13*c* and the intermediate wall 13*d*, even when the force generated by the above-mentioned friction between the cleaning blade 11*a* and the photosensitive drum 7 is applied to the cleaning frame 13, the cleaning frame 13 is not deformed. When it is required that rigidity is further increased, the appropriate number of partition ribs 13*d*1 (perpendicular to the connecting portion 13*c* and the intermediate wall 13*d*) may be provided between the connecting portion 13*c* and the intermediate wall 13*d* to define a plurality of smaller box-shaped ribs.

Further, between a lower surface 13*g* of the recessed portion 21 of the cleaning frame 13 for receiving the arm portion of the developing frame 12 and the drum gear 7*b*, there are provided a rib 13*h*1 extending substantially in parallel with the lower surface 13*g*, a vertical rib 13*h*2 extending perpendicular to the rib 13*h*1 and the intermediate wall 13*d*, and a rib 13*h*3 extending perpendicular to the rib 13*h*1 and in parallel with the intermediate wall 13*d*. By providing a box-shaped rib defined by the lower surface 13*g* and the ribs 13*h*1, 13*h*2, 13*h*3 and the above-mentioned box-shaped ribs defined by the connecting portion 13*c*, intermediate wall 13*d* and partition ribs 13*d*1, box-shaped spaces, opened toward the longitudinal direction, are formed. With this arrangement, even when the above-mentioned thicknesses are reduced, the rigidity of the cleaning frame 13 for supporting the photosensitive drum 7 can be maintained to substantially the same extent as before thicknesses are reduced, and the amount of resin for molding the cleaning frame 13 can be reduced.

The vertical rib 13*h*2 (having a wall perpendicular to the longitudinal direction) extending perpendicular to the vertical intermediate wall 13*d* (FIG. 14) having a wall directing toward the longitudinal direction is disposed at a position where a thrust regulating portion 8*a*1 provided on the bearing 8*a* of the charge roller 8 can abut against the vertical rib 13*h*2 to prevent axial movement of the charge roller 8. The thrust regulating portion 8*a*1 is integrally formed with the charge roller bearing 8*a* for rotatably supporting the charge roller shaft 8*c* and is slidingly contacted with a sliding end surface 8*d* of the charge roller shaft 8*c*. The charge roller bearings 8*a* are received in the vertical guide members 13*s* of the cleaning frame 13 for vertical movement, so that the charge roller 8 is urged against the photosensitive drum 7 via the charge roller bearings 8*a* by compression springs 8*e* disposed between ends of guide grooves of the guide members 13*s* and the charge roller bearings 8*a*. With this arrangement, during transportation, even if a shock directed in the longitudinal direction and caused by dropping, is applied to the charge roller 8, since the thrust regulating portion 8*a*1 abuts against the rib 13*h*2, the axial movement of the charge roller 8 due to the dropping shock can be prevented, with the result that there is no danger of damaging the thrust regulating portion 8*a*1 and disengaging the charge roller bearings 8*a* from the guide members 13*s*.

FIG. 16 is a side view showing an outline of the cleaning frame 13. The end surfaces or surfaces of the above-mentioned connecting portions, intermediate wall and ribs, according to the illustrated embodiment, are exposed outside. The end surfaces of ribs 13*h*1, 13*h*3, the lower rib portion 13*d*1 and the intermediate wall portion 13*d* below the rib 13*h*1 are perpendicular to the longitudinal direction. Further, the end surfaces of the upper rib portion 13*d*1, the upper intermediate wall portion 13*d* and the lower surfaces 13*g* of the recessed portions are perpendicular to the longitudinal direction. The former end surfaces are retarded in the longitudinal direction in comparison with the latter end surfaces when looked at from outside. The side walls 13*b* are hemmed by a rib 13*k* flush with the end surface of the connecting portion 13*c*, and a rib 13*m* interconnects the rib 13*k* and the upper wall 13*j*. Further, an upper end of the rib 13*h*3 above the photosensitive drum 7 and the upper wall 13*j* is interconnected by a rib 13*n*.

Next, the shaft members 24 for connecting the cleaning frame 13 and the developing frame 12 will be explained. As mentioned above, the process cartridge B is constituted by rotatably interconnecting the developing unit D and the cleaning unit C by the shaft members (circular pins) 24.

As shown in FIG. 15, each recessed portion 21 of the cleaning frame 13 for receiving the corresponding arm portion 23 of the developing frame 12 is a space enclosed by the recessed portion upper wall 13*j*, recessed portion lower wall 13*g*, outer wall member 13*w*1 and inner wall member 13*w*2. As shown in FIG. 14, a part of the intermediate wall 13*d* forms a rear wall of the space (FIGS. 14 and 15). A boss 13*w*4 extending outwardly in the longitudinal direction is formed on the inner wall member 13*w*2 and the press-fit portion 13*e*2 is formed at the center of the boss 13*w*4. The arm portion 23 of the developing frame 12 can enter between the boss 13*w*4 and the outer wall member 13*w*1. A boss 13*w*3 extending outwardly in the longitudinal direction is formed on the outer wall member 13*w*1, and the attachment hole 13*e*1 is formed in the center of the boss 13*w*3. The attachment hole 13*e*1, press-fit hole 13*e*2 and rotation hole 25 of the arm portion 23 have the same nominal diameter and are coaxial with each other, and, the respective shaft member 24 is loosely fitted into the attachment hole 13*e*1 and the rotation hole 25 and press-fitted into the press-fit hole 13*e*2.

The shaft member 24 is inserted in a direction shown by the arrow a in FIGS. 13 and 15. A tip end (inserting direction) of the shaft member 24 protrudes from the end surface of the press-fit portion 13*e*2 by about 2 to 3 mm to define a protruded portion 24*a* (protruded amount=m). A trail end of the shaft member penetrates into the end surface of the attachment hole 13*e*1 by a penetrate amount l of about 0 to 1 mm. And, a rib 13*i* is formed on the cleaning frame 13 between the tip end of the shaft member and the cleaning blade metal plate 11*a*1 at a position spaced apart from the tip end by a distance n of 4 to 5 mm. A length p of the fitting between the shaft member 24 and the attachment hole 13*e*1 is selected to be greater than the distance n between the tip end of the shaft member 24 and the rib 13*i*, so that, if the shaft member 24 excessively penetrates due to an erroneous operation by the operator, the shaft member 24 abuts against the rib 13*i* to prevent the shaft member from dropping within the process cartridge B, thereby preventing damage to the photosensitive drum 7 and/or process means such as the developing roller 10*d*. The reason why the trail end of the shaft member 24 penetrates into the end surface of the boss 13*w*3 having the attachment hole 13*e*1 is that the shaft member 24 is prevented from being contacted by the operator carelessly.

The protruded amount m (2 to 3 mm) of the tip end of the shaft member 24 protruding from the press-fit hole 13*e*2 is selected to be greater than the penetrated amount l (0 to 1 mm) of the trail end. The reason is that, in the recycling of the process cartridge B, when the protruded portion 24*a* of the shaft member 24 is pushed back by inserting a tool between the tip end of the shaft member 24 and the rib 13*i*, since the trail end of the shaft member 24 protrudes from the outer end surface of the boss 13*e*3 having the attachment hole 13*e*1, by drawing the shaft member by pinchers and the like to remove the shaft member, the cleaning unit C can be disassembled from the developing unit D. If the shaft member 24 is inserted with excessive force to abut the tip end thereof against the rib 13*i*, by strongly pushing a surface of the rib 13*i* opposite to the surface against which the shaft member 24 abuts, the shaft member may be pushed back while deforming the rib 13*i*. Since the penetrated amount l is selected to zero or small value, the trail end of the shaft member 24 can easily be protruded from the outer end surface of the boss 13*e*3 having the attachment hole 13*e*1. Accordingly, in such a case, the cleaning unit C can be disassembled from the developing unit D.

With the arrangement as mentioned above, the shaft member can be prevented from dropping within the process cartridge, and the shaft member is prevented from being contacted by the operator carelessly, and, in the recycling of the catridge, the process cartridge can easily be disassembled.

As mentioned above, according to the illustrated embodiment, there can be provided a cartridge frame, a process cartridge, and an electrophotographic image forming apparatus to which such a process cartridge can detachably be mounted, in which longitudinal ends of a charge member are rotatably supported and an outward shifting movement of the charge member is surely regulated by a support member for regulating the outward shifting movement of the charge member.

Further, according to the illustrated embodiment, there can be provided a process cartridge, and an electrophotographic image forming apparatus to which such a process cartridge can detachably be mounted, in which a shaft rotatably interconnecting a cartridge frame and a developing frame for supporting a developing member can be prevented from being disengaged.

What is claimed is:

1. A cartridge frame used in a process cartridge which includes an electrophotographic photosensitive member, a charge member for charging said electrophotographic photosensitive member, and a support member for rotatably supporting longitudinal ends of said charge member and for regulating an outward shifting movement of said charge member in a longitudinal direction, the cartridge frame being detachably mountable to a main body of an electrophotographic image forming apparatus, said cartridge frame comprising:

(a) a first mounting portion for mounting said electrophotographic photosensitive member;

(b) a second mounting portion for mounting said support member;

(c) a regulating portion for regulating an outward shifting movement in a longitudinal direction of said support member when said charge member is supported by said support member mounted on said second mounting portion; and (d) a support portion for supporting a periphery of said regulating portion, wherein said regulating portion is transverse to the longitudinal direction, and a space is defined by said regulating portion and said support portion extending from the periphery of said regulating portion.

2. A cartridge frame according to claim 1, wherein said regulating portion has a rectangular shape, and said support portion extends from four sides of the rectangular shape.

3. A cartridge frame according to claim 2, wherein said first and second mounting portions, said regulating portion and said support portion are integrally molded from plastic material.

4. A process cartridge detachably mountable to a main body of an electrophotographic image forming apparatus, comprising:

(a) an electrophotographic photosensitive member;

(b) a charge member for charging said electrophotographic photosensitive member;

(c) a support member for rotatably supporting longitudinal ends of said charge member and for regulating an outward shifting movement of said charge member in a longitudinal direction; and (d) a cartridge frame including a first mounting portion for mounting said electrophotographic photosensitive member, a second mounting portion for mounting said support member, a regulating portion for regulating a longitudinal outward shifting movement of said support member when said charge member is supported by said support member mounted on said second mounting portion, and a support portion for supporting a periphery of said regulating portion, wherein said regulating portion is transverse to the longitudinal direction, and a space is defined by said regulating portion and said support portion extending from the periphery of said regulating portion.

5. A process cartridge according to claim 4, wherein said regulating portion has a rectangular shape, and said support portion extends from four sides of the rectangular shape.

6. A cartridge frame according to claim 5, wherein said first and second mounting portions, said regulating portion and said support portion are integrally molded from plastic material.

7. A process cartridge according to one of claims 4, 5, or 6, further comprising a shaft for rotatably interconnecting said cartridge frame and a developing frame supporting a developing member for developing a latent image formed on said electrophotographic photosensitive member, and wherein said shaft is fitted into a hole formed in said cartridge frame and a hole formed in said developing frame, and an outer end surface of said shaft transverse to the longitudinal direction is positioned inside of an outer end surface of said hole of said cartridge frame transverse to the longitudinal direction.

8. A process cartridge according to one of claims 4, 5, or 6, further comprising at least one of a developing member for developing a latent image formed on said electrophotographic photosensitive member and a cleaning member for removing residual developer remaining on said electrophotographic photosensitive member.

9. An electrophotographic image forming apparatus for forming an image on a recording medium, comprising:

(a) a mounting means for detachably mounting a process cartridge onto a main body, said process cartridge including (i) an electrophotographic photosensitive member, (ii) a charge member for charging said electrophotographic photosensitive member, (iii) a support member for rotatably supporting longitudinal ends of said charge member and for regulating an outward shifting movement of said charge member in a longitudinal direction, and (iv) a cartridge frame having a first mounting portion for mounting said electrophotographic photosensitive member, a second mounting portion for mounting said support member, a regulating portion for regulating a longitudinal outward shifting movement of said support member when said charge member is supported by said support member mounted on said second mounting portion, and a support portion for supporting a periphery of said regulating portion, wherein said regulating portion is transverse to the longitudinal direction, and a space is defined by said regulating portion and said support portion extending from the periphery of said regulating portion; and (b) a convey means for conveying the recording medium.

10. A cartridge frame used in a process cartridge which includes an electrophotographic photosensitive drum, a charge roller for charging said electrophotographic photosensitive drum and comprising a charge roller shaft, and two charge roller bearings, each charge roller bearing rotatably supporting one longitudinal end of said charge roller and regulating an outward shifting movement of said charge roller in a longitudinal direction, each charge roller bearing comprising a thrust regulating portion, wherein said thrust regulating portion is integral with said charge roller bearing and slidingly contacts a sliding end surface of said charge roller shaft, the cartridge frame being detachably mountable to a main body of an electrophotographic image forming apparatus, said cartridge frame comprising:

a waste toner containing portion;

two side walls;

two drum bearings each attached to one of said side walls and supporting one end of said electrophotographic photosensitive drum, each drum bearing comprising a boss and a bearing rib, wherein each boss is coaxial with the rotation axis of said electrophotographic photosensitive drum;

two inner walls, spaced from said two side walls toward the interior of said cartridge frame;

two guide members, each guide member guiding one of said charge roller bearings for vertical movement;

two compression springs, each positioned between one of said guide members and one of said inner walls, wherein said charge roller is urged against said electrophotographic photosensitive drum via said charge roller bearings and said compression springs; and a vertical regulating rib for regulating an outward shifting movement in a longitudinal direction of said thrust regulating portion of said charge roller bearings when said charge member is supported by said charge roller bearings guided by said guide members, wherein said vertical regulating rib abuts said thrust regulating portion of said charge roller bearings to prevent axial movement of said charge roller; and a box-shaped rib comprising said vertical regulating rib and the following additional elements:

a surface extending perpendicular to a longitudinal direction of said cartridge frame;

a first rib extending substantially parallel with said surface; and a second rib extending perpendicular said first rib, wherein said vertical regulating rib extends perpendicular to said first rib and to the longitudinal direction, wherein said cartridge frame comprises a developing frame, and a cleaning frame housing said waste toner containing portion, said side walls, said drum bearings, said two compression springs, said two inner walls, said two guide members, said vertical regulating rib, and said box-shaped rib, wherein the width of said cartridge frame increases in steps from said waste toner containing portion toward the developing frame.

11. A process cartridge detachably mountable to a main body of an electrophotographic image forming apparatus, said cartridge frame comprising:

an electrophotographic photosensitive drum;

a charge roller for charging said electrophotographic photosensitive drum and comprising a charge roller shaft;

two charge roller bearings, each charge roller bearing rotatably supporting one longitudinal end of said charge roller and regulating an outward shifting movement of said charge roller in a longitudinal direction, each charge roller bearing comprising a thrust regulating portion, wherein said thrust regulating portion is integral with said charge roller bearing and slidingly contacts a sliding end surface of said charge roller shaft; and a cartridge frame supporting said electrophotographic photosensitive drum, said a charge roller, and said charge roller bearings, said cartridge frame comprising:

a waste toner containing portion;

two side walls;

two drum bearings each attached to one of said side walls and supporting one end of said electrophotographic photosensitive drum, each drum bearing comprising a boss and a bearing rib, wherein each boss is coaxial with the rotation axis of said electrophotographic photosensitive drum;

two inner walls, spaced from said two side walls toward the interior of said cartridge frame;

two guide members, each guide member guiding one of said charge roller bearings for vertical movement;

two compression springs, each positioned between one of said guide members and one of said inner walls, wherein said charge roller is urged against said electrophotographic photosensitive drum via said charge roller bearings and said compression springs;

a vertical regulating rib for regulating an outward shifting movement in a longitudinal direction of said thrust regulating portion of said charge roller bearings when said charge member is supported by said charge roller bearings guided by said guide members, wherein said vertical regulating rib abuts said thrust regulating portion of said charge roller bearings to prevent axial movement of said charge roller; and a box-shaped rib comprising said vertical regulating rib and the following additional elements:

a surface extending perpendicular to a longitudinal direction of said cartridge frame;

a first rib extending substantially parallel with said surface; and a second rib extending perpendicular said first rib, wherein said vertical regulating rib extends perpendicular to said first rib and to the longitudinal direction, wherein said cartridge frame comprises a developing frame, and a cleaning frame housing said waste toner containing portion, said side walls, said drum bearings, said compression springs, said two inner walls, said two guide members, said vertical regulating rib, and said box-shaped rib, wherein the width of said cartridge frame increases in steps from said waste toner containing portion toward the developing frame.

* * * * *

UNITED STATES PATENT AND TRADEMARK OFFICE

CERTIFICATE OF CORRECTION

PATENT NO. : 6,208,818 B1
DATED : March 27, 2001
INVENTOR(S) : Shinya Noda

It is certified that error appears in the above-identified patent and that said Letters Patent is hereby corrected as shown below:

Column 2,
Line 46, "be" should be deleted.

Column 3,
Line 19, "entire" should read -- the entire --.

Column 5,
Line 12, "are guided and the ribs 18b" should read -- and the ribs 18b are guided --.
Line 13, "configurations" should read -- configuration --.

Column 6,
Line 35, "flat" should read -- flat and --.

Column 7,
Line 44, "deleteriously to" should read -- deleteriously --.
Line 47, "a" should be deleted.

Column 12,
Line 29, "springs; and" should reads -- springs; --.
Line 44, "said a" should read -- said --.

Column 13,
Line 8, "said a" should read -- said --.

Column 14,
Line 13, "perpendicular" should read -- perpendicular to --.

Signed and Sealed this

Twenty-ninth Day of January, 2002

*Attest:*

*Attesting Officer*

JAMES E. ROGAN
*Director of the United States Patent and Trademark Office*